US006916274B2

(12) United States Patent
Glusco

(10) Patent No.: US 6,916,274 B2
(45) Date of Patent: Jul. 12, 2005

(54) APPARATUS AND METHOD FOR PHYSIOLOGICAL TESTING INCLUDING CARDIAC STRESS TEST

(76) Inventor: Mark C. Glusco, 818 Greens Blvd., #307, Myrtle Beach, SC (US) 29577

( * ) Notice: Subject to any disclaimer, the term of this patent is extended or adjusted under 35 U.S.C. 154(b) by 0 days.

(21) Appl. No.: 10/633,979

(22) Filed: Aug. 4, 2003

(65) Prior Publication Data

US 2005/0032608 A1 Feb. 10, 2005

(51) Int. Cl.[7] ..... A63B 21/00
(52) U.S. Cl. ..... 482/8; 482/1; 600/300
(58) Field of Search ..... 482/1–9, 900–902; 600/300, 323, 355

(56) References Cited

U.S. PATENT DOCUMENTS

| | | | | |
|---|---|---|---|---|
| 2,784,591 A | | 3/1957 | Shoor | 73/379 |
| 3,057,201 A | | 10/1962 | Jaeger | 73/379 |
| 3,744,480 A | | 7/1973 | Gause et al. | 128/2.05 R |
| 3,750,479 A | | 8/1973 | Gause et al. | 73/379 |
| 4,285,515 A | | 8/1981 | Gezari | 272/73 |
| 4,372,551 A | | 2/1983 | Yurdin | 972/73 |
| 5,313,942 A | | 5/1994 | Platzker | 128/639 |
| 5,362,069 A | * | 11/1994 | Hall-Tipping | 463/7 |
| 5,461,739 A | | 10/1995 | Falbo, Sr. | 5/607 |
| 5,571,063 A | | 11/1996 | Ivanov | 482/57 |
| 5,616,104 A | * | 4/1997 | Mulenburg et al. | 482/57 |
| 5,678,263 A | | 10/1997 | Berthe | 5/600 |
| 5,746,684 A | | 5/1998 | Jordan | 482/62 |
| 6,273,856 B1 | * | 8/2001 | Sun et al. | 600/300 |

* cited by examiner

*Primary Examiner*—Glenn E. Richman
(74) *Attorney, Agent, or Firm*—Michael E. Mauney

(57) ABSTRACT

A physiological stress testing method and apparatus which provides customized exercise routines that allows an individual to exercise at their own rate, while still challenging the individual to achieve maximal desirable heart rates and exercise stress loads. An apparatus that provides at the user's option to use different major muscle groups, but without requiring weight bearing on joints. A gradually increasing work load is applied. The work load applied by the apparatus is the same regardless of the speed or efficiency at which a patient operates the apparatus. This maximizes a user's opportunity to reach a desired physiological stress level either in a stress testing context or in an exercise context. The apparatus ordinarily will use an electromagnetic resistance unit and a controller with a central processing unit to adjust the resistance to control the work load.

10 Claims, 2 Drawing Sheets

APPARATUS AND METHOD FOR PHYSIOLOGICAL TESTING INCLUDING CARDIAC STRESS TEST

BACKGROUND OF THE INVENTION

1. Field of the Invention

This invention described herein relates in general to medical stress test measuring apparatuses, methods, and specialized exercise equipment. In particular, it relates to an improved apparatus for cardiac stress testing, methods for cardiac stress testing, and specialized exercise equipment.

2. Description of Related Art

Some heart abnormalities do not show up in an electrocardiogram taken when the patient is at rest. However, it may be possible to induce the heart to beat faster, which may reveal abnormalities not otherwise diagnoseable. In order to stress the heart, there are two widely used protocols. One is called the Bruce protocol. In the Bruce protocol, the individual to be tested is placed on a treadmill inclined at a grade of 10 percent. The treadmill begins to move and an individual begins to walk on the treadmill in order to remain in the same place. The person's heart condition is monitored by an electrocardiogram. During the Bruce protocol the blood pressure is periodically checked. The speed and inclined grade of the treadmill is increased in stages causing an individual being tested to have to walk faster and work harder because of the steeper incline to stay in the same place. In this fashion, it is hoped an appropriate elevated heart rate will be achieved. Ideally, an individual should reach 90% of their maximum predicted heart rate for their age before having to terminate the test. This test presents challenges for some individuals. Some people have orthopedic problems like a bad knee that make it difficult or impossible to perform the walking required. Other conditions which can make it difficult for an individual to perform the exercise in the Bruce protocol include various forms of arthritis, diabetic problems like ulcers or neuropathy, and peripheral vascular disease. Moreover, the abrupt increase in the exercise loads required in the Bruce protocol are difficult or impossible for patients who have impaired respiratory function including those with COPD and asthma. Ordinarily, patients who cannot perform the exercise required in a Bruce protocol, follow a protocol called the Persantine cardiolyte stress test. There a person is placed on a table with an intravenous inlet port. A drug (dipyridaxide), called by the trade name, Persantine, is infused through the IV port. Persantine causes the heart to beat at an increased rate. Persantine dilates the coronary arteries and accelerates the heart rate. Photographic images are taken with an x-ray machine using cardiolyte or thallium. This helps the cardiologist determine if the patient has ischemia by analyzing the images taken during times of physical stress and at rest. The ischemic portion of the heart will appear differently because it will not illuminate through the cardiolyte or thallium as well as a fully profused part of the heart. Many people have unpleasant reactions to Persantine, which include headache, dizziness, flushed skin, and, shortness of breath. For many people, the effect of having the heart beat very hard is both unpleasant and anxiety provoking.

A variety of devices have been proposed to improve or modify the application of stress and exercise both in cardiac testing and in other circumstances. For example, Yurdin U.S. Pat. No. 4,372,531 proposes a cardiac stress table to be used in a cardiac nuclear imaging procedure. This procedure usually requires a patient to be motionless on a table while being scanned. Yurdin combines a tiltable table for supporting a patient in a restrained position combined with a stationery bicycle-like device to enable one to combine an exercise stress challenge with a nuclear imaging test. Jordan U.S. Pat. No. 5,746,684 proposes an exercise stand that includes a stationery bicycle-like pedal arrangement along with a variety of hand holds. Jordan proposes that the hand holds can isometrically exercise the upper body while the pedal device isotonically exercises the lower extremities. Gezari U.S. Pat. No. 4,285,515, proposes an improved table, which includes a stationery bicycle-like device, as well as tilting moveable support for a patient. This provides for support during exercise for scintillation camera scanning. Platzker U.S. Pat. No. 5,313,942 proposes an improved electrode system for administering an EKG test, which also provides a chair with removable exercise accessories. The electrodes are embedded in a strap which passes around a patient's chair. A stationery bicycle or hydraulic pusher device may be provided to a patient to provide exercise stress during an EKG test.

For many individuals, especially individuals with impaired cardiac or respiratory systems, standard exercise equipment proves unsatisfactory for achieving satisfactory heart rates. For such an individual, consider a resistance based stationary bicycle exercise equipment. With this kind of exercise equipment one may adjust the amount of resistance or effort that is required for an individual to turn the pedals. At a certain preset level of resistance, the faster one pedals, the greater work one does, hence the greater amount of energy is expended, which tends to elevate the heart rate and to increase the breathing rate to increase the body's metabolism to meet the demands imposed by the work load required by a bicycle. In this kind of arrangement, a problem arises for certain individuals. If the resistance level is set low, the individual can comfortably work the device but will have difficulty achieving sufficient speed to induce the required work load, hence elevate the heart rate to a desired level. If the resistance is set relatively high, then the individual may stop because of leg muscle fatigue or cramping before the appropriate heart rate is achieved. There are stationary exercise bicycles which function in a different fashion. One is sold under the trade name of Kettler. This uses an electromagnetic force on a flywheel to induce resistance to motion of the pedals. The electromagnetic force can be easily varied by a controller to increase or decrease the force required to move the pedals, hence the work load required to operate the Kettler exercise bicycle. However, typically, the Kettler exercise bicycle is used by highly conditioned individuals trying to improve their exercise efficiency. That is, they will set the bicycle so that they will perform at a certain constant RPM. This is the level at which they are able to efficiently use their legs to pedal the bicycle, while maintaining proper form. The Kettler bicycle will then impose a gradually increasing work load on the individual enabling them to train to maintain their most efficient pedaling stroke at a higher work load. Neither of the above type of machines function adequately for an unconditioned individual who may have impairments like arthritis or a limited ability to pedal a stationary bicycle or to maintain a particular speed under increasing work loads.

SUMMARY OF THE INVENTION

Despite this earlier work, there is a need for different individually tailored stress test protocols and an apparatus to execute those protocols for individuals who otherwise may not be able to complete a cardiac stress test. In the Bruce protocol, the grade of a treadmill is initially 10 percent.

Functional capacity required to complete the first stage of the protocol is 4.7 metabolic equivalents or METS. For elderly or deconditioned individuals, this initial stage may be too severe for the individuals to complete. Thereafter, each stage of the protocol requires a 3 MET increase per stage. At the fourth stage of the Bruce protocol, the treadmill is moving at 4.2 mph. For many individuals, this is faster than a walk, but slower than a run. Under the Bruce protocol the initially large and uneven MET jumps required create acidotic conditions, especially for deconditioned individuals or those with cardiac abnormalities. Typically, deconditioned patients do not have sufficient oxygen extraction, aerobic enzymes, and lactic acid buffering systems, when combined with low muscle, cardiorespiratory, and ventilatory fitness, to be able to benefit from such a test protocol. Oftentimes, deconditioned patients will stop because of fatigue without ever reaching their maximum heart rate and MET level for accurate test results. Many patients must resort to the Persantine protocol. This protocol often results in an uncomfortable and frightening feeling. Some patients experience headache, dizziness, flushed skin, lightheadedness, and shortness of breath.

It is a goal of the current invention to provide a more comfortable stress test protocol, avoiding excessive lactic acid accumulation, aggravation of orthopedic conditions, or other functional incapacities, while still reaching maximal heart rates, volume of oxygen ($VO_2$) values, a respiratory/expiratory exchange ratio near one, and a rate of perceived exertion (RPE) that is very high. This system utilizes a questionnaire to arrive an estimated $VO_2$. A lower and calculated tolerable starting level of exercise is part of the protocol. The individual is required to produce more work as the protocol proceeds. However, use of gradual increases in the work output from the patient limits lactic acid accumulation and oxygen deficits at the early stages of the protocol. The protocol is designed to last between eight and twelve minutes. There will be an electrocardiogram print-out with accompanying heart rate measurement every minute. Blood pressure, RPE and rate pressure products will be taken every three minutes.

The preferred piece of equipment to conduct the protocol is a special stationary exercise bicycle. This bicycle has standard pedals, which are used by a patient's legs. However, the individual may also be required to use his or her arms to move handles for the stationary bicycle. The seat will be designed for comfort for the patient, will be padded, and will have a back rest support. The back rest is adjustable to recline at different levels, including full recline in the event medical treatment is required for a patient during the course of the protocol. The pedals and the arm exercise handles connect to a sprocket-like disk. Moving the handles as well as the pedals rotate the disk. A belt runs from the disk to a fly wheel on the exercise cycle. The flywheel runs through an adjustable electronic resistance gear. This electronic resistance gear can be adjusted to provide resistance in terms of watts or work required from a patient using the device. The electronic resistance gear is designed to require a constant work output from a patient regardless of the disk speed. That is, if a patient pedals fast, or moves the handles fast less resistance is applied by the electronic resistance gear. If a patient pedals slowly or moves the handles slowly, a greater amount of resistance is applied so that the work output is the same regardless of the speed the patient pedals or moves the handles. Unlike prior protocols like the Bruce protocol, which impose speed of use requirements on a patient, the electronic resistance imposes the same work load regardless of speed of use by a patient. Using the specially designed equipment of this invention allows many patients to successfully complete a cardiac stress test who cannot complete other cardiac stress testing protocols. This means that a patient may exercise at the rate most comfortable for them, but still will be required to meet the protocol's gradually increasing work load.

Another goal of the exercise equipment used in the stress test protocol described above is to be useful for individuals who have difficulty making best use of a standard exercise bicycle. First, it uses both the arms and legs. Secondly, the work load imposed is independent of the speed of the operation of the device. Third, the device may be programmed to impose a gradually increasing work load. Fourth, the movement efficiency of the individual in operating the device is irrelevant to the results received. Using this equipment a deconditioned individual may use both arms and legs initially at a low work out put. They may pedal fast or move the arms fast should they choose to do so or they may pedal slowly or move the arms slowly or use some combination. The work load imposed by this invention compensates automatically for the speed of the individual's motion so that a constant work load is achieved regardless of speed of use. As the work load gradually increases, an individual will be meeting that increasing work load so long as they move the arms or pedals, even at a decreased speed. Individuals who are stronger in the arms than in the legs may use their arms more than their legs or for individuals whose legs are stronger than their arms, they may use their legs more than their arms to maintain a constant output to meet the work load demand imposed by the exercise equipment. Just as in the protocol designed for the cardiac stress testing, individuals may easily achieve a desired heart rate, hence training level, even though they may have impairments such as bad knees, arthritis, neuropathy, or peripheral vascular disease.

DETAILED DESCRIPTION OF THE DRAWINGS

Figure 1:
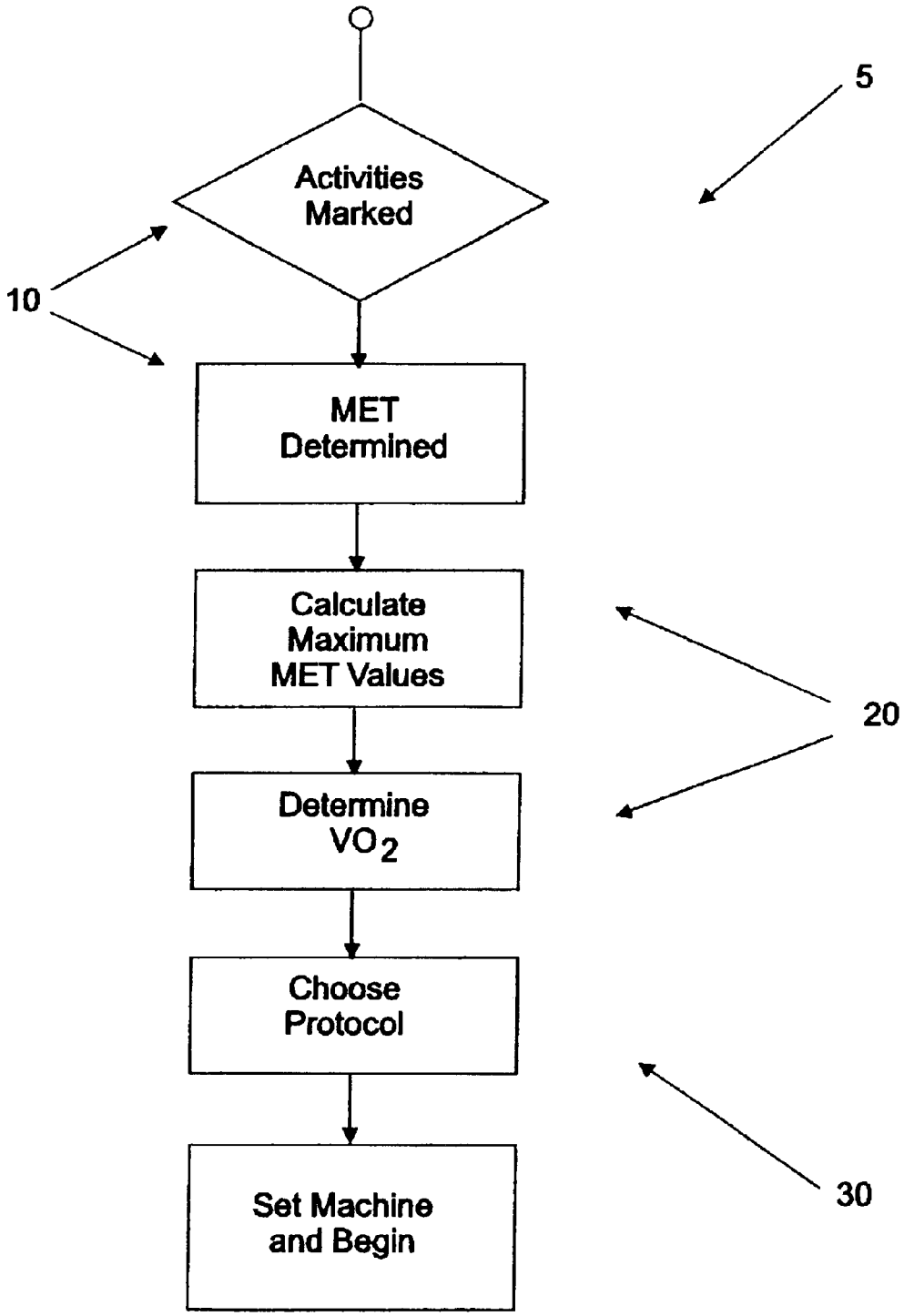
FIG. 1 shows a flow chart for a protocol for a stress test.

FIG. 1 is a flow chart showing how a stress test protocol (5) is determined. To determine a protocol (5), the first step is to determine an estimated MET value (10) for a patient. A patient will be given an activities list, as is shown below in Table 1.

TABLE ONE

| |
|---|
| Archery |
| Backpacking |
| Badminton |
| Basketball |
| Billiards |
| Bowling |
| Boxing |
| Canoeing, rowing, kayaking |
| Conditioning exercise |
| Climbing hills |
| Cricket |
| Croquet |
| Cycling |
| Dancing (social, square, tap) |
| Dancing (aerobic) |
| Fencing |
| Field hockey |
| Fishing |

TABLE ONE-continued

| |
|---|
| Football |
| Golf |
| Handball |
| Hiking |
| Horseback riding |
| Horseshoe pitching |
| Hunting |
| Judo |
| Mountain climbing |
| Music playing |
| Paddleball, racquetball |
| Rope jumping |
| Running |
| Sailing |
| Scuba diving |
| Shuffleboard |
| Skating, ice and roller |
| Skiing, snow |
| Skiing, water |
| Sledding, tobagganing |
| Snowshoeing |
| Squash |
| Soccer |
| Stair climbing |
| Swimming |
| Table tennis |
| Volleyball |

A patient will be asked to check the activities done within the last three months with a first distinguishable mark. The second request is to have an individual use a second distinguishable mark to indicate the activities that have been completed within the last month. The final instruction is to ask this subject to use a third distinguishable mark to indicate the activities that are completed on a regular basis, usually defined as those done more than once in a two-week period of time. The activities that have more than one mark beside them will be extracted from the list. Of those activities, the ones with the highest MET value from a guideline of MET values will be chosen. A guideline is defined here as a developed set of MET values determined for particular activities. One guideline that has been found to work is the *ACSM Guidelines for Exercise Testing and Prescription* and specifically the list presented on pages 164 and 165 of these guidelines. This particular list provides the mean value and a range of MET values for the activity. From the activities that were marked more than once by a patient, the one that has the highest MET value, as defined by the guidelines, will determine the MET value used to establish a protocol for that patient. In FIG. 1 the determination of a MET value (10) step is shown by the initial diamond box and by the box immediately below the Activities Recorded diamond box.

The next step is to calculate a $VO_2$ value (20). It is assumed when a person engages in recreational activities like those shown in Table 1, he or she does not do so at the highest level. Ordinarily, people exercise at around 50 to 80 percent of their maximal functional capacity. Therefore, the MET value taken from the *ACSM Guidelines for Exercise Testing and Prescription* is multiplied by two to arrive at a maximal MET guideline. It is assumed if a person exercises in the activity indicated in the questionnaire on a regular basis, then their maximum MET value will be approximately twice the MET value as determined from the guidelines. In order to convert this estimated MET value to a volume of oxygen value ($VO_2$), the derived MET value is multiplied by 3.5 to convert it into a $VO_2$ value, which is milliliters of oxygen consumed per kilogram of weight per minute. This maximal estimated $VO_2$ value is multiplied by the subject's body weight in kilograms. Multiplying the $VO_2$ by kilograms yields a figure in milliliters per minute estimated as the maximum oxygen consumption of a person at full functional capacity. The higher the milliliter per minute of oxygen consumption the better the physical condition of a subject. A person who has a high consumed oxygen capacity is presumed to be able to do more and presumed to be able to handle a more stressful work load applied by the exercise equipment in order to reach maximum exercise capacity for the individual. Shown below is a protocol table. The protocols are lettered "A" through "G". Based on the value derived, a protocol is chosen (30) for that particular patient.

TABLE TWO

| |
|---|
| A~9275–6190.5 ml/min |
| B~6190.5–4270.5 ml/min |
| C~4270.5–3177.5 ml/min |
| D~3177.5–2119.5 ml/min |
| E~2119.5–1520.75 ml/min |
| F~1520.75–1135 ml/min |
| G~1135–838.5 ml/min |

The actual protocols and exercise load applied by the protocol is shown below in Table 3 below. The machine is set and the protocol begun using the settings in Table 3.

TABLE THREE

| |
|---|
| A - Starts at 30 watts and increases 30 watts every 30 seconds. |
| B - Starts at 30 watts and increases 20 watts every 30 seconds. |
| C - Starts at 30 watts and stays constant until the one minute mark and increases 15 watts every 30 seconds. |
| D - Starts at 30 watts and stays constant until the one minute mark and increases 10 watts every 30 seconds. |
| E - Starts at 30 watts and stays constant until the one minute mark and increases 10 watts every 30 seconds until the three minute mark and increases 5 watts every 30 seconds. |
| F - Starts at 25 watts and stays constant until the three minute mark and increases 5 watts every 30 seconds. |
| G - Starts at 25 watts and stays constant until the six minute mark and increases 5 watts every 30 seconds. |

Figure 2:
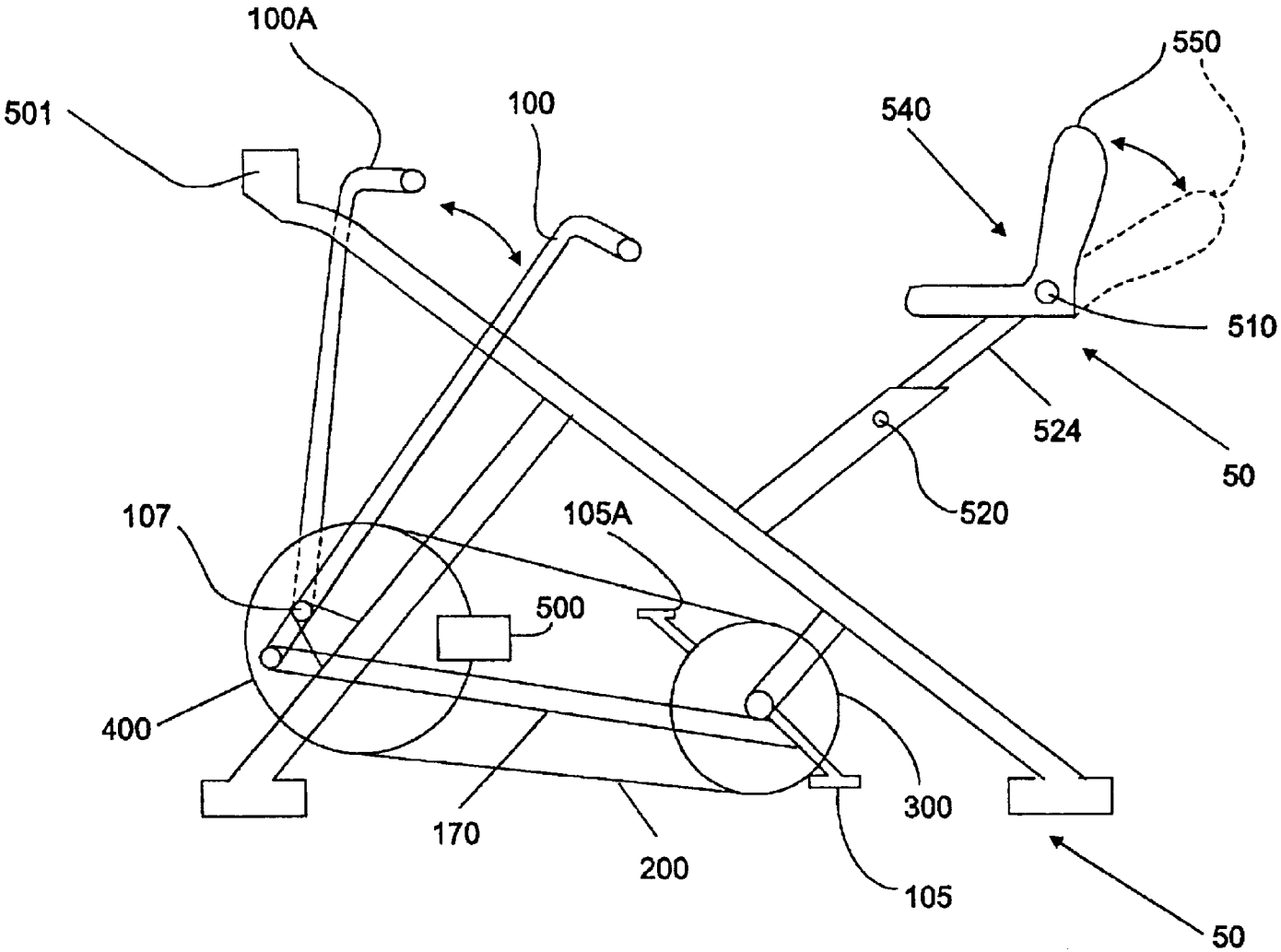
FIG. 2 shows a drawing of exercise equipment to be used in carrying out the protocol of FIG. 1.

FIG. 2 shows the preferred embodiment stress testing exercise equipment (50) as seen from the side in a stylized form. A patient (not shown) will sit in the seat (540) usually in an upright position with the back supported by the back rest (550). The back rest (550) will tilt on a pivoting axis (510) to assume a number of positions, including a recumbent position, which is shown in dotted lines in FIG. 2. The seat (540) and the back rest (550) are adjustable to accommodate different sized individuals. The seat (540) telescopes to move both closer to and away from the pedals (105, 105A) on each side of the stress testing equipment (50) by means of a sliding support post (524) and an adjustment knob (520) thus adjusting to accommodate different sizes users. The patient (not shown) will place the feet on the pedals (105, 105A) and the hands on the arm handles (100, 100A) and begin to use them. The arm handles (100, 100A) rotatably move on an axis (107) and each is connected to a connecting rod (170, 170A) (Connecting rod 170A is not shown but will be understood to be on the unseen side of the stress testing equipment (50)). The connecting rod (170, 170A) is connected to the pedals (105, 105A). As a patient (not shown) grips the arm handles (100, 100A) and moves them back and forth in a lateral direction with the user's arms. This causes the arm handles (100, 100A) to move around the axle (107). The connecting rod (170, 170A) is attached to an end of the arm handles (100, 100A) opposite from the point a user will grip and move the arm handles (100, 100A) in an approximate lateral back and forth motion. As the arm handles (100, 100A) move about the axle (107), the ends of the arm handles (100, 100A) opposite from the grip end moves in a direction opposite to motion induced by a user. This causes the connecting rods (170, 170A) to rotate the pedals (105, 105A) in response to the lateral motion of the connecting rods (170, 170A). The pedals (105, 105A) are connected to a disk (300). As the pedals (105, 105A) rotate, they cause a rotary motion in the disk (300). A belt (200) passes over the disk (300) and over a flywheel (400). As the disk (300) rotates, frictional resistance of the belt (200) to the disk (300) causes the belt (200) to move in response to rotary motion of the disk (300) communicating by frictional resistance a rotary movement to the flywheel (400). The flywheel (400) will ordinarily be constructed of a metal with magnetic properties. Consequently, an electronic resistance unit (500) can be electrically operated to apply a magnetic force to the flywheel (400). The magnetic force applied by the electronic resistance unit (500) to the flywheel (400) can be directly controlled by a supply of electrical power or current to the electronic resistance unit (500). A control unit (501) may be equipped with appropriate instrumentation including a microchip or computer processing unit (CPU) to control the supply of electrical current to the electronic resistance unit (500). This means that the control unit (501) can be programmed to provide a constant level of work required to move the flywheel (400) regardless of the rotational speed the flywheel (400) is moving. This programming is well known to one of skill in the art. The flywheel's (400) rotational speed can be can be sensed and sent to the control unit (501) in a number of standard ways. The work required to meet the protocol's standard can then be imposed by the control unit (501) by appropriately increasing or decreasing the resistance imposed on the flywheel (400) by the resistance unit (500). A display unit (not shown) can show a readout to a user or clinician for real time monitoring of the work done by a user on the stress testing exercise equipment (50). Consequently, a patient's movement of the pedals (105, 105A) with the patient's feet and a patient's movement of the arm handles (100, 100A) can be slow or fast, but still require the same constant level of work through the control unit (501) the electronic resistance unit (500) and the flywheel (400). The importance of this will be explained later, but the use of the electronic resistance unit (500) which can control the amount of work done by a patient using the arm handles (100 and 100A) and the pedals (105, 105A) enable a precise programming designed to maximize the possibility of a user reaching appropriate levels of physical exercise in a stress testing environment.

One type of commercially available fitness machine that allows for variably increased work loads in watts is made by a manufacturer that goes by the trade name of Kettler. A particular model sold which embodies the electronic resistance and feed back for a constant work load regardless of the speed of use features of the current invention is sold under the trade name Ergoracer. The particular Kettler Ergoracer model does not have arm handles and is used solely as a stationary cycle and is envisioned by the manufacturer for use for training for athletes. It is designed solely for a pedaling motion using the lower body muscles including the legs and hips. However, the modification of a Kettler-like design by including arm handles and appropriate connection to the pedals allows the use of a Kettler-type electronic resistance to produce an application that provides advances in current stress testing procedures. The currently used stress test procedure calls for an individual to walk at an incline of 10%. Some individuals who may wish to do a stress test may have orthopedic limitations which will prevent them from walking at all or from walking at a grade of 10%. However, an individual who may have difficulty in walking for a variety of reasons like joint problems can nevertheless use the legs in a pedaling motion in a stationary cycle. Also, it allows those individuals who may have compromised exercise abilities, for example an excessively overweight individual, who may have difficulty walking on a grade of 10% with weight bearing on ankles and knees, can nevertheless easily operate a cycle where weight is born by the seat. The use of the above described exercise stress testing equipment (50) allows an initial low and light exercise load for an individual. An individual can use arms and/or legs to whatever degree the individual is comfortable. The initial low values of starting at 25 watts or 30 watts of exercise load allows even a deconditioned individual to grow accustomed to the equipment and to begin a warmup period before the work loads increase. The use of the electronic resistance allows a steady increase of work load or watts to be applied at a predetermined interval. It has been found that increases of 5 watts, 10 watts, 15 watts, 20 watts or 30 watts at 30 second intervals work well. Moreover, as is described using Table 3, a program may be tailored precisely for a particular individual. Consequently, an individual who weighs 375 pounds may have a very different MET capacity than one weighing 100 pounds. A deconditioned, sedentary 375 pound individual might be placed at level F or G in Table 3 whereas a 100 pound triathlete might go at level B or A despite the disparity in size. The protocol as described in Tables 1, 2, and 3 and the stress testing equipment (50) allow a protocol to be tailored to an individual. The beginning of the test will ordinarily feel easy and require only light exertion from a user. The use of slow, gradual and even increases in the amount of work required from a user as is shown by the use of level watt increases for each protocol representing a letter in Table 3 provides a sense of a gradually increasing and manageable exercise load. The gradually ramping increase of exercise load delays the onset of blood lactate accumulation, an $O_2$ debt or sense of being out of breath and the feeling of fatigue in the major muscles groups including the legs and arms. The protocol is designed to challenge an individual so that an individual will be able to reach the maximum predicted heart rate within approximately eight to twelve minutes after the start of the protocol. It is important to note that the use of the electronic resistance can be controlled by a control unit (501) to apply the protocol work load regardless of the speed at which a patient or user actually pedals the pedals or moves the arm handles. Thus, in the Bruce protocol as the speed of the treadmill increases and as its incline increases there are many individuals who, for a variety of physical limitations unconnected to cardiac limitations, may be unable to complete the protocol. Simply put, they may not be able to walk on that kind of incline or at that speed. Likewise, for many standard stationary bicycles, the faster one pedals the greater resistance one encounters and the greater work load is imposed by the exercise bicycle. The equipment used, such as a treadmill or an exercise bicycle, which requires a patient to perform at a particular speed to achieve a particular resistance level, will fail to appropriately stress the cardiac system for many individuals. The failure occurs because that individual will be unable to reach the level of exertion, not because of a lack of cardiac capacity, but rather because of other limitations including psychological limitations. Therefore, the desire of the clinician to impose a particular level of stress on a patient's cardiac system is not achieved and the test results are not accurate. However, using the electronic resistance of the current invention coupled with the use of the upper body using the arm handles (100, 100A) and the lower body using the pedals (105, 105A) allows virtually any individual to respond to the increasing resistance and work load demands imposed by the stress testing equipment (50) in a way that is most comfortable and most likely to reach an appropriate level of stress on the cardiac system for that patient. The lack of impact and the relatively stationary position of a patient using the exercise equipment and protocol as described above will also make it relatively easy to take blood pressure readings as opposed to the Bruce protocol. In the Bruce protocol as the patient walks, there is necessarily some movement back and forth and a certain amount of pounding as the feet land on the treadmill. However, here the patient remains stationary and it is much easier to take a blood pressure reading during the course of the test. Consequently, use of the above described equipment with the individually designed protocols based on an individualized determination of a patient's likely level of fitness and ability to exercise is far more likely to achieve repeatable and valuable clinical results in a cardiac stress testing environment.

As in other exercise stress testing, it will be important to obtain ongoing clinical information about a patient undergoing a stress testing protocol on the stress testing equipment (50). Ordinarily, an electrocardiogram printout will be taken on a frequent basis along with a heart rate measurement. Also on a periodic basis, other clinical measurements will be taken including blood pressures and rate pressure products. These clinical values will be recorded on a specifically designed sheet which incorporates information about the particular protocol including the amount of work being done by the subject at the time the clinical values are determined. The use of both upper and lower body muscles is designed to make individuals who may have impairments in one area of the body still proper subjects for use of the stress testing equipment (50) in this protocol.

It will be readily appreciated that the advantages of the protocol described above for challenging an individual to reach a maximal heart rate in a cardiac stress test can be easily adopted for use by an individual who may have the same orthopedic or other limitations to achieve and maintain a heart rate at a specified level sufficient to result in cardiorespiratory training. As was explained above, the current piece of exercise equipment (50) will allow an individual to use both their arms and their legs at their comfort level. Secondly, the gradually increasing work load can be imposed independent of the speed at which the individual uses the equipment. Therefore, the individual sets their own speed of use rather than having the speed of use imposed on them by the equipment. Third, the gradually increasing work load will tend to avoid undue fatigue in the muscles that are operating the equipment, be it leg or arm muscles, before appropriate heart rates are achieved. Fourth, an individual who may have difficulty making efficient movements with their arms and legs to operate the equipment may have difficulty achieving a training level of resistance in standard exercise equipment. However, here the efficiency of the movements of the arms and legs are not challenged by the equipment, but rather the equipment adjusts to impose a desired work load on a user regardless of their efficiency in operating the equipment. Therefore, this equipment lets disabled individuals, who may have difficulty in using standard stationary bicycles, treadmills, stair steppers, or the like, use this equipment for cardiorespiratory training, allowing them to reach and maintain a desired heart rate level across a particular exercise period. The work load required to reach that level can be individually tailored to the individual and imposed by the controller (501) in the stress testing exercise equipment (50). The work load imposed is independent of the speed of use by the individual and enables many individuals to complete a training program who cannot do so on a standard piece of exercise equipment.

I claim:

1. A physiological stress testing method comprising:

(a) calculating a metabolic equivalent for an individual;

(b) from said calculated metabolic equivalent estimating a volume of oxygen value;

(c) establishing a test protocol based on said volume of oxygen value wherein said test protocol establishes a predetermined work load that increases at predetermined intervals, said predetermined work load is higher when the volume of oxygen values are higher;

(d) placing a patient on an exercise apparatus that applies said predetermined work load regardless of how fast said exercise apparatus is operated;

(e) measuring physiological parameters of said patient during said protocol and stopping said protocol when said patient has reached a predetermined level for physiological parameters.

2. A physiological stress testing method of claim 1 wherein said step of providing an exercise apparatus further includes said exercise apparatus operating so that said patient's joints are not required to bear said patient's weight while carrying out said test protocol.

3. A physiological stress testing method of claim 2 wherein said step of providing exercise equipment further provides allowing said patient a choice of using different major muscle groups of said patient on said exercise equipment in carrying out said protocol.

4. A physiological stress testing method of claim 3 wherein said step of providing exercise equipment further includes using a controllable electromagnetic resistance for said exercise apparatus to apply said step of applying a predetermined work load for said patient.

5. A physiological stress testing method of claim 4 wherein said step of allowing said patient a choice of using different major muscle groups involves allowing at least a choice of using the legs in a pedaling-like motion and/or the arms to move handles in a back-and-forth motion on said exercise equipment in carrying out said protocol.

6. A physiological stress testing method of claim 5 wherein said step of applying a predetermined work load further comprises sensing how fast a patient is operating said exercise apparatus and adjusting said controllable electronic resistance whereby said patient is required to exert said predetermined work load regardless of how fast said patient is operating said exercise apparatus.

7. An apparatus that is self-adjusting and applies a predetermined work load to a user regardless of how fast the exercise apparatus is operated for use in the physiological stress testing method of claim 1 comprising:

(a) a frame with a seat, with pedals, and movable handles;

(b) for said seat, said seat having an adjustable back, which may rotate so that said seat may be varied from uptight to horizontal;

(c) a resistance apparatus that moves in response to motion of said pedal and said handles;

(d) means for applying a resistance to said resistance apparatus;

(e) means for adjusting said means for applying a resistance;

(f) means for controlling said means for adjusting;

whereby a constant work load may be applied through said exercise equipment regardless of the speed at which a user moves said pedals and/or said handles.

8. An apparatus that is self-adjusting and applies a predetermined work load to a user regardless of how fast the exercise apparatus is operated of claim 7 wherein said means for applying a resistance is an electromagnet and said resistance apparatus is constructed of material responsive to magnetic force.

9. An apparatus that is self-adjusting and applies a predetermined work load to a user regardless of how fast the exercise apparatus is operated of claim 8 wherein said means for adjusting further comprises an adjustable electrical Current applied to said electromagnet.

10. An apparatus that is self-adjusting and applies a predetermined work load to a user regardless of how fast the exercise apparatus is operated of claim 9 wherein said means for controlling further comprises, at least in part, a central control unit which can control said adjustable electrical current so that a predetermined resistance may be applied by said adjustable electrical current to said resistance apparatus.

* * * * *